US010036358B2

(12) United States Patent
Akutsu

(10) Patent No.: US 10,036,358 B2
(45) Date of Patent: Jul. 31, 2018

(54) FUEL SUPPLY DEVICE OF ENGINE

(71) Applicant: SUZUKI MOTOR CORPORATION, Hamamatsu-Shi, Shizuoka-Ken (JP)

(72) Inventor: Gen Akutsu, Hamamatsu (JP)

(73) Assignee: Suzuki Motor Corporation (JP)

( * ) Notice: Subject to any disclaimer, the term of this patent is extended or adjusted under 35 U.S.C. 154(b) by 11 days.

(21) Appl. No.: 15/368,831

(22) Filed: Dec. 5, 2016

(65) Prior Publication Data

US 2017/0198670 A1 Jul. 13, 2017

(30) Foreign Application Priority Data

Dec. 7, 2015 (JP) ..... 2015-238194

(51) Int. Cl.
*F02M 55/00* (2006.01)
*F02M 59/44* (2006.01)
*F02M 55/02* (2006.01)

(52) U.S. Cl.
CPC ..... *F02M 55/005* (2013.01); *F02M 55/025* (2013.01); *F02M 59/44* (2013.01)

(58) Field of Classification Search
CPC ..... F02M 55/005; F02M 55/025; F02M 59/44
USPC ..... 123/468, 469, 456, 508, 445, 470
See application file for complete search history.

(56) References Cited

U.S. PATENT DOCUMENTS 1,931,215 A * 10/1933 Woolson ..... F02B 75/22 123/449
3,934,903 A * 1/1976 Hofmann ..... F02M 55/002 239/533.3
5,127,382 A * 7/1992 Imoehl ..... F02M 51/005 123/456
6,340,019 B1 * 1/2002 Eshleman ..... F02M 69/465 123/469
6,732,711 B2 * 5/2004 Yanagii ..... F02M 55/025 123/456
6,892,706 B2 * 5/2005 Kienzler ..... F02M 55/002 123/456
6,990,959 B1 * 1/2006 Zdroik ..... F02M 69/462 123/184.31
7,063,074 B2 * 6/2006 Horibe ..... F02M 35/10078 123/468

(Continued)

FOREIGN PATENT DOCUMENTS

JP 2001-241754 A 9/2001

*Primary Examiner* — Thomas Moulis
*Assistant Examiner* — John Bailey
(74) *Attorney, Agent, or Firm* — Barnes & Thornburg LLP

(57) ABSTRACT

A fuel supply device of an engine is provided, which has high versatility irrespective of specifications of the engine, and thus easily achieves economies of mass production, and has high cost-effectiveness even in the engine of small-lot production. The fuel supply device of the engine comprises a high pressure fuel pump that raises pressure of fuel and discharges the fuel, a plurality of fuel injectors, and a fuel supply piping that distributes the fuel discharged from the high pressure fuel pump to the fuel injectors. The fuel supply piping includes a plurality of sockets that are connected to the fuel injectors respectively, a junction pipe that connects adjacent sockets among the plurality of sockets, and a stay that integrally connects the plurality of sockets and fixes the plurality of sockets to a main body of the engine.

15 Claims, 6 Drawing Sheets

(56) References Cited

U.S. PATENT DOCUMENTS 8,061,332 B1 * 11/2011 Harbert ..... F02M 51/005 123/195 C
8,262,137 B2 * 9/2012 Okuno ..... F16L 37/101 285/242
8,267,431 B2 * 9/2012 Okuno ..... F02M 55/02 285/242
8,844,502 B2 * 9/2014 Solferino ..... B23P 19/00 123/456
9,352,796 B2 * 5/2016 Tani ..... B62J 37/00
9,453,485 B2 * 9/2016 Masti ..... F16L 3/00
2003/0221672 A1 * 12/2003 Zdroik ..... F02M 69/465 123/456
2004/0159302 A1 * 8/2004 Horibe ..... F02M 35/10078 123/195 C
2006/0157031 A1 * 7/2006 Kaishio ..... F02M 55/004 123/456
2008/0202472 A1 * 8/2008 Whatley ..... F02M 69/465 123/469
2009/0031992 A1 * 2/2009 Lysinger ..... F02M 55/02 123/470
2009/0223489 A1 * 9/2009 Furchill ..... F02M 69/465 123/456
2010/0242872 A1 * 9/2010 Sato ..... F01L 13/0063 123/54.4
2010/0244434 A1 * 9/2010 Okuno ..... F02M 55/02 285/24
2013/0174814 A1 * 7/2013 Sugiyama ..... F02M 21/0248 123/525
2014/0123951 A1 * 5/2014 Imakita ..... F02M 55/025 123/469
2014/0261330 A1 * 9/2014 Doherty ..... F02M 63/0275 123/456
2014/0283789 A1 * 9/2014 Bartell ..... F02M 55/025 123/456
2015/0007794 A1 * 1/2015 Kawata ..... F02M 69/042 123/445
2015/0176556 A1 * 6/2015 Harada ..... F02M 61/14 123/456
2015/0192082 A1 * 7/2015 Guerreiro ..... F02D 41/14 123/456
2015/0246702 A1 * 9/2015 Tani ..... B62J 37/00 180/219
2015/0369185 A1 * 12/2015 Takahata ..... F02M 37/0017 123/468
2015/0369193 A1 * 12/2015 Harada ..... F02M 55/025 123/294
2016/0195054 A1 * 7/2016 Guengoer ..... F02M 55/025 123/469
2017/0306909 A1 * 10/2017 Tanaka ..... B60K 15/01

* cited by examiner

FUEL SUPPLY DEVICE OF ENGINE

CROSS-REFERENCE TO RELATED APPLICATIONS

This application claims the benefit of priority of Japanese Patent Application No. 2015-238194, filed on Dec. 7, 2015, the entire contents of which are incorporated herein by reference.

BACKGROUND OF THE INVENTION

Field of the Invention

The present invention relates to a fuel supply device of an engine.

Description of the Related Art

The fuel supply device of an engine includes a fuel supply piping that distributes fuel to fuel injectors of respective cylinders.

Conventional fuel supply piping includes a pipe main body portion having a fuel passage, an inlet pipe that introduces fuel to the pipe main body portion, a plurality of mountings that distribute fuel to respective injectors from the fuel passage, and a communication passage that connects the fuel passage and the mounting. The conventional fuel supply piping is an integrally molded product of a resin. (Refer to Japanese Patent Laid-Open No. 2001-241754, for example.)

SUMMARY OF THE INVENTION

The conventional fuel supply piping, which is the integrally molded product, is designed at each time in accordance with specifications of an engine, for example, the number of cylinders, and spaces between fuel injectors. Unfortunately, the conventional fuel supply device has low versatility, a molding die has to be produced for the specifications of each of the engines, as a result of which, economies of mass production cannot be achieved, and cost is increased.

Further, it is difficult to apply the conventional fuel supply device to a small-lot product from an aspect of cost-effectiveness.

To solve the problems described above, it is an object of the present invention to provide a fuel supply device of an engine that has high versatility irrespective of specifications of the engine, readily achieves economies of mass production, and is high in cost-effectiveness even in the engine of small-lot production.

To achieve the above object, an aspect of the present invention provides the fuel supply device of the engine including a fuel pump raising pressure of fuel and discharging the fuel, a plurality of fuel injectors, and a fuel supply piping distributing the fuel discharged from the fuel pump to the fuel injectors. The fuel supply piping includes a plurality of sockets connected to the fuel injectors respectively, at least one junction pipe connecting adjacent sockets, and a stay integrally connecting the sockets and fixing the sockets to an engine main body.

This fuel supply device of the engine can be provided, which has high versatility irrespective of specifications of the engine, and thus easily achieves economies of mass production, and has high cost-effectiveness even in the engine of small-lot production.

DETAILED DESCRIPTION OF THE PREFERRED EMBODIMENT

Hereinafter, an embodiment of a fuel supply device of an engine according to the present invention will be described with reference to FIGS. 1 to 6.

Figure 1:
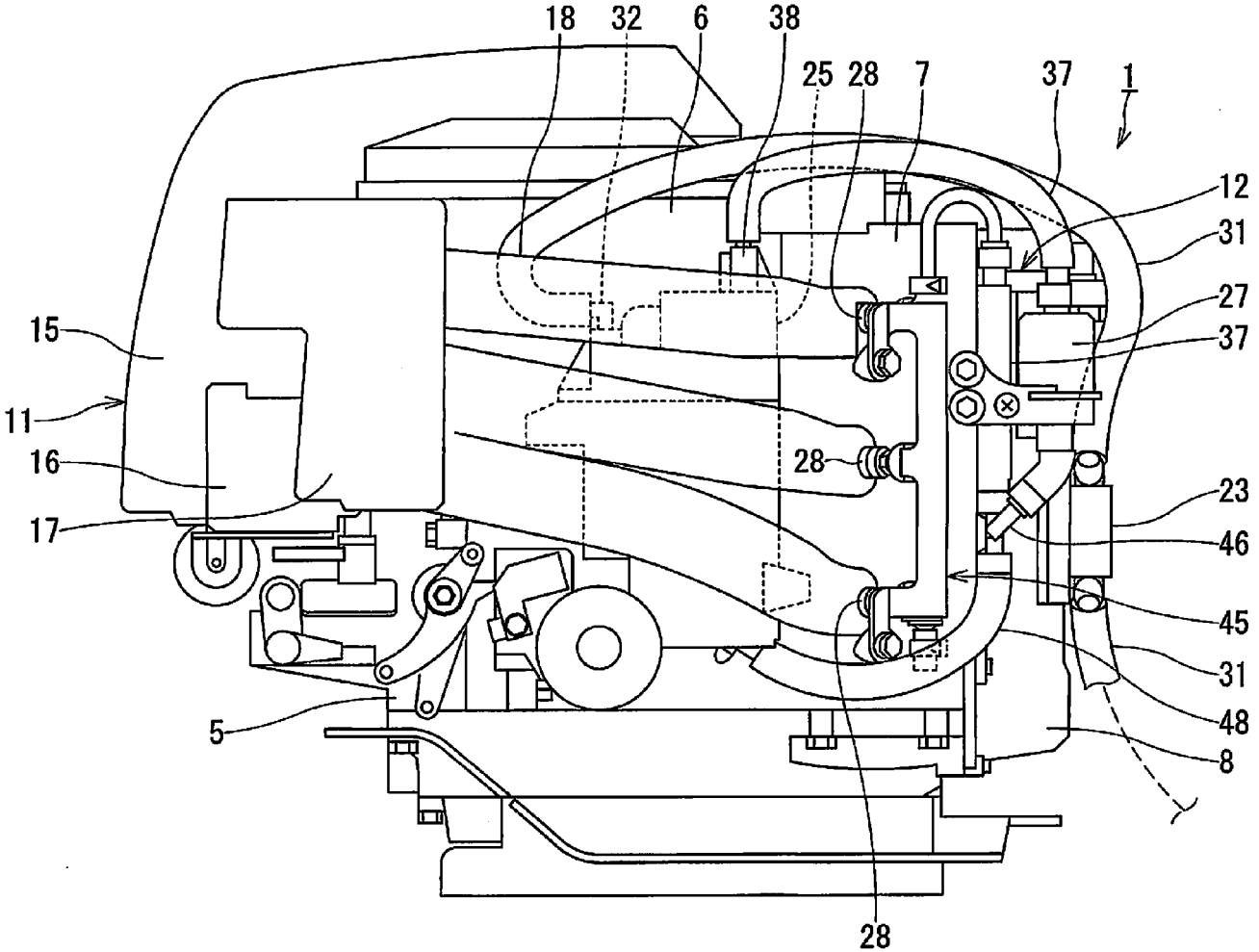
FIG. 1 is a side view illustrating one example of an engine to which a fuel supply device according to an embodiment of the present invention is applied.

FIG. 1 is a side view illustrating one example of an engine to which the fuel supply device according to the embodiment of the present invention is applied.

As shown in FIG. 1, a reciprocating engine 1 according to the present embodiment is, for example, a water-cooled four-cycle three-cylinder engine. The engine 1 includes a crankcase 5, a cylinder block 6, a cylinder head 7 and a head cover 8. The engine 1 is applied to an outboard motor (not illustrated), for example.

The crankcase 5 is disposed at a foremost of the engine 1. The cylinder block 6 is disposed in a rear of the crankcase 5. The cylinder head 7 is disposed in a rear of the cylinder block 6. The head cover 8 is disposed in a rear of the cylinder head 7. In a junction portion of the crankcase 5 and the cylinder block 6, a crankshaft (not illustrated) is pivotally supported. The crankshaft is accommodated in the crankcase 5 and the cylinder block 6 with a center of rotation oriented substantially vertically.

Around the engine 1, an intake device 11, electric and electronic equipment (not illustrated) and a fuel supply device 12 are provided.

The intake device 11 is disposed at one side portion of the engine 1, in this embodiment, at a left side portion of the engine 1. The intake device 11 includes a silencer 15, a throttle body 16, a surge tank 17 and a plurality of intake manifolds 18 that extends to the respective cylinders from the surge tank 17.

The throttle body 16 is disposed at a left front side of the crankcase 5, for example. The silencer 15 is disposed at an upstream side of the throttle body 16. The surge tank 17 is disposed at a downstream side of the throttle body 16.

The intake manifolds 18 are disposed at a side portion of the cylinder block 6. The intake manifolds 18 extend to the respective cylinders in the cylinder head 7 from the surge tank 17. The intake manifolds 18 are arranged in a vertical direction.

The electric and electronic equipment is intensively disposed at another side portion of the engine 1, that is, at a right side of the engine 1 which is an opposite side to the intake device 11.

Figure 2:
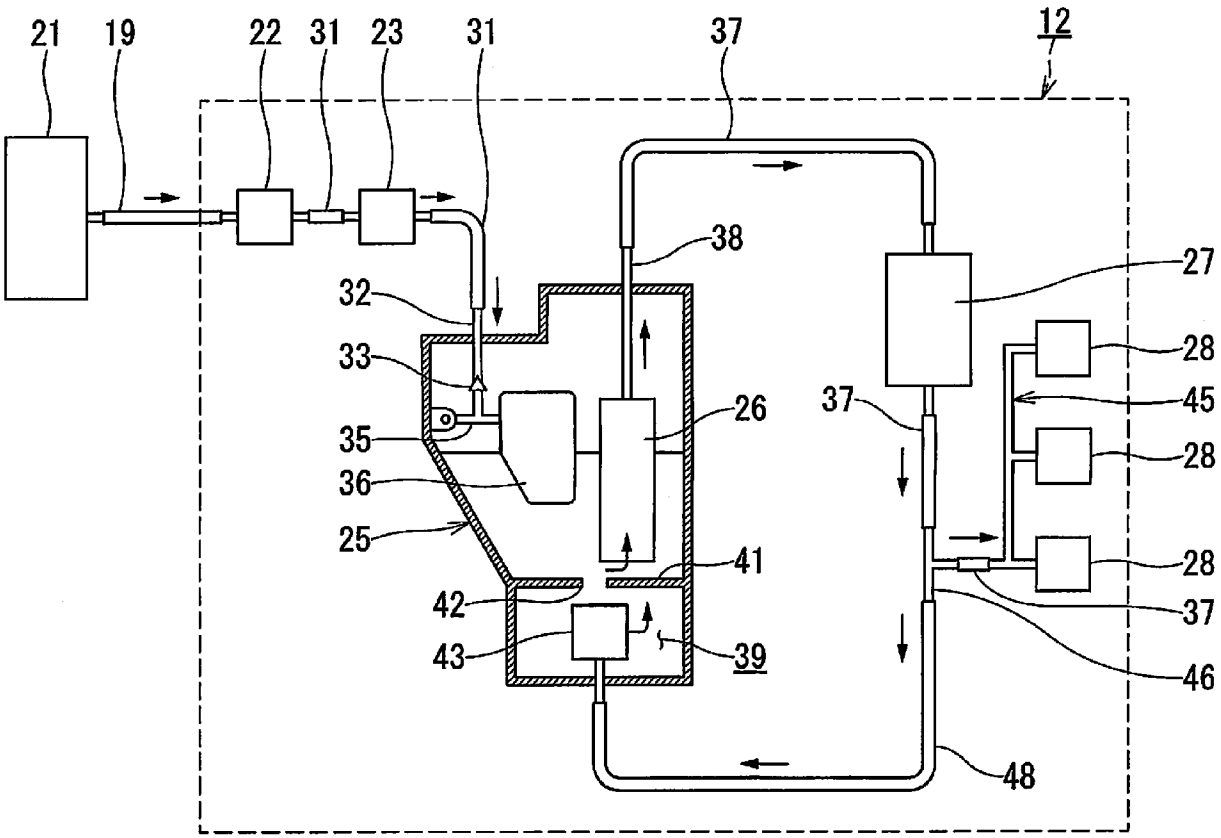
FIG. 2 is a block diagram of the fuel supply device of the engine according to the embodiment of the present invention.

FIG. 2 is a block diagram of the fuel supply device of the engine according to the embodiment of the present invention.

As illustrated in FIG. 2 in addition to FIG. 1, the fuel supply device 12 according to the present embodiment is connected to a fuel tank 21 that is loaded on a watercraft such as a boat (not illustrated), for example, via a fuel supply hose 19.

The fuel supply device 12 includes a low pressure fuel filter 22 that is connected to the fuel supply hose 19, a low pressure fuel pump 23 that is driven by a valve train (not illustrated) of the engine 1, a vapor separator 25 that separates fuel vapor contained in liquid fuel, for example, gasoline, and releases the vapor into the atmosphere, a high pressure fuel pump 26 that is provided in the vapor separator 25, sucks the fuel from which vapor is separated, raises pressure of the fuel and discharges the fuel, a high pressure fuel filter 27, and a plurality of fuel injectors 28.

The low pressure fuel pump 23 is disposed in the head cover 8. The low pressure fuel pump 23 sucks fuel in the fuel tank 21, raises pressure of the fuel and discharges the fuel. The low pressure fuel pump 23 is connected to the low pressure fuel filter 22 via a low pressure fuel hose 31.

The low pressure fuel filter 22 is connected to the vapor separator 25 via the low pressure fuel hose 31.

The vapor separator 25 is disposed in a space that separates a left side surface of the cylinder block 6 and the intake manifold 18. The vapor separator 25 is fixed to an inner side of the intake manifold 18 with a fastener such as a bolt (not illustrated), for example. An inside of the vapor separator 25 is a temporary storage tank of fuel, that is, a fuel sump.

At an upper portion of the vapor separator 25, a fuel inflow port 32 is provided. The fuel inflow port 32 is connected to the low pressure fuel hose 31. A needle valve 33 is provided at an outlet of the fuel inflow port 32. The needle valve 33 operates together with a float 36 via a hinge mechanism 35. The float 36 floats in the fuel in the vapor separator 25. The float 36 operates the needle valve 33 in accordance with a change of a liquid level of the fuel in the vapor separator 25. Further, a fuel discharge port 38 is provided at the upper portion of the vapor separator 25. The fuel discharge port 38 is connected to a high pressure fuel hose 37.

A partition plate 41 is provided at a lower portion in the vapor separator 25, in other words, a lower portion of the fuel sump. The partition plate 41 defines a separate room 39 in a bottom portion of the vapor separator 25. The partition plate 41 has an opening 42. The opening 42 connects the fuel sump and the separate room 39. In the separate room 39, a pressure regulator 43 is disposed. The pressure regulator 43 guides high-pressure fuel into the vapor separator 25.

The high pressure fuel pump 26 is soaked in the fuel in the vapor separator 25. The high pressure fuel pump 26 is connected to the high pressure fuel filter 27 via the high pressure fuel hose 37.

The high pressure fuel filter 27 is connected to the fuel injectors 28 via a fuel supply piping 45. That is, the fuel supply piping 45 distributes the fuel that is discharged from the high pressure fuel pump 26 to the fuel injectors 28.

The fuel that is discharged from the high pressure fuel pump 26 passes through the high pressure fuel filter 27, and is fed to the fuel supply piping 45 via the high pressure fuel hose 37.

The fuel supply piping 45 is connected to the fuel injectors 28 of the respective cylinders.

A branch pipe 46 is provided at a midpoint in the high pressure fuel hose 37 that connects the high pressure fuel filter 27 and the fuel supply piping 45. One downstream end of the branch pipe 46 is connected to the fuel supply piping 45 via the high pressure fuel hose 37. Another downstream end of the branch pipe 46 is connected to the pressure regulator 43 in the vapor separator 25 via a hose 48.

The fuel in the fuel tank 21 is pumped up by the low pressure fuel pump 23, is filtered by the low pressure fuel filter 22, and thereafter, is guided into the vapor separator 25 from the fuel inflow port 32. The needle valve 33 operates together with the float 36 with a rise of the liquid level of the fuel in the vapor separator 25, restricts inflow of the fuel by closing the outlet of the fuel inflow port 32, and prevents overflow of the vapor separator 25. When the liquid level of the fuel in the vapor separator 25 is reduced with consumption of the fuel, the float 36 lowers, and the needle valve 33 opens the outlet of the fuel inflow port 32. From the outlet of the fuel inflow port 32 which is opened, the fuel is supplied into the vapor separator 25.

Vapor is separated from the fuel, which accumulates in the vapor separator 25. The vapor separated from the fuel is released to the atmosphere outside the vapor separator 25. The fuel having no bubble is fed to the fuel supply piping 45 through the high pressure fuel filter 27 from the fuel discharge port 38 by the high pressure fuel pump 26. The high pressure fuel that is fed to the fuel supply piping 45 is distributed to the fuel injectors 28.

Note that a pressure of the fuel in the hose 48, which extends from the branch pipe 46, is a specified pressure or less as long as fuel injection is performed normally, and therefore, the pressure regulator 43 is closed.

When consumption of the fuel of the engine 1 decreases by reason of e.g. a speed of the engine 1 is low, and the pressure of the fuel in the fuel supply piping 45 increases to be a specified pressure or more, a pressure of the fuel in the hose 48 also increases, and the pressure regulator 43 is opened to decrease the pressure of the fuel in the fuel supply piping 45.

Next, the fuel supply piping 45 of the fuel supply device 12 will be described in detail.

Figure 3:
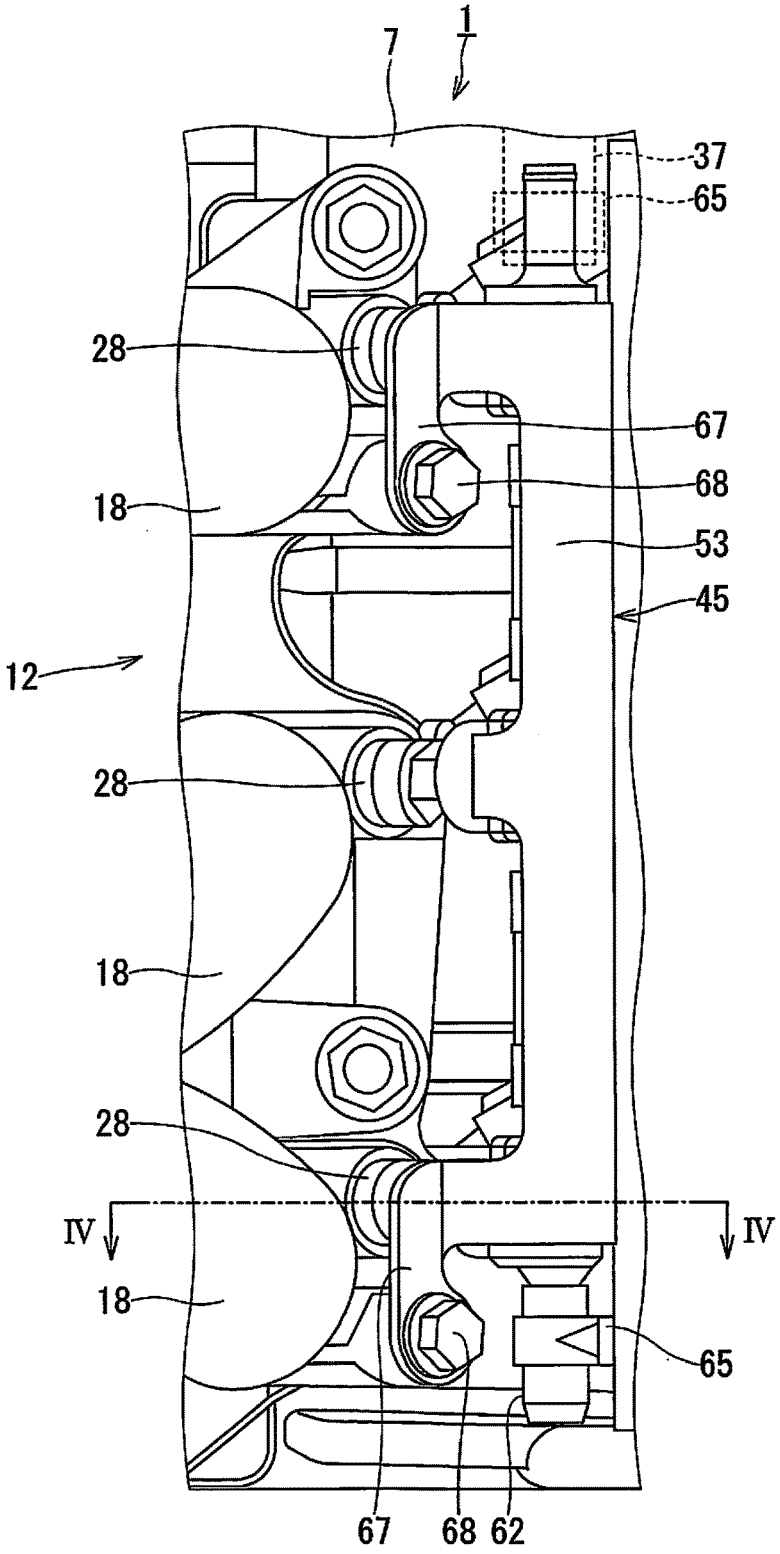
FIG. 3 is an enlarged view of a fuel supply piping of the fuel supply device according to the embodiment of the present invention.
Figure 4:
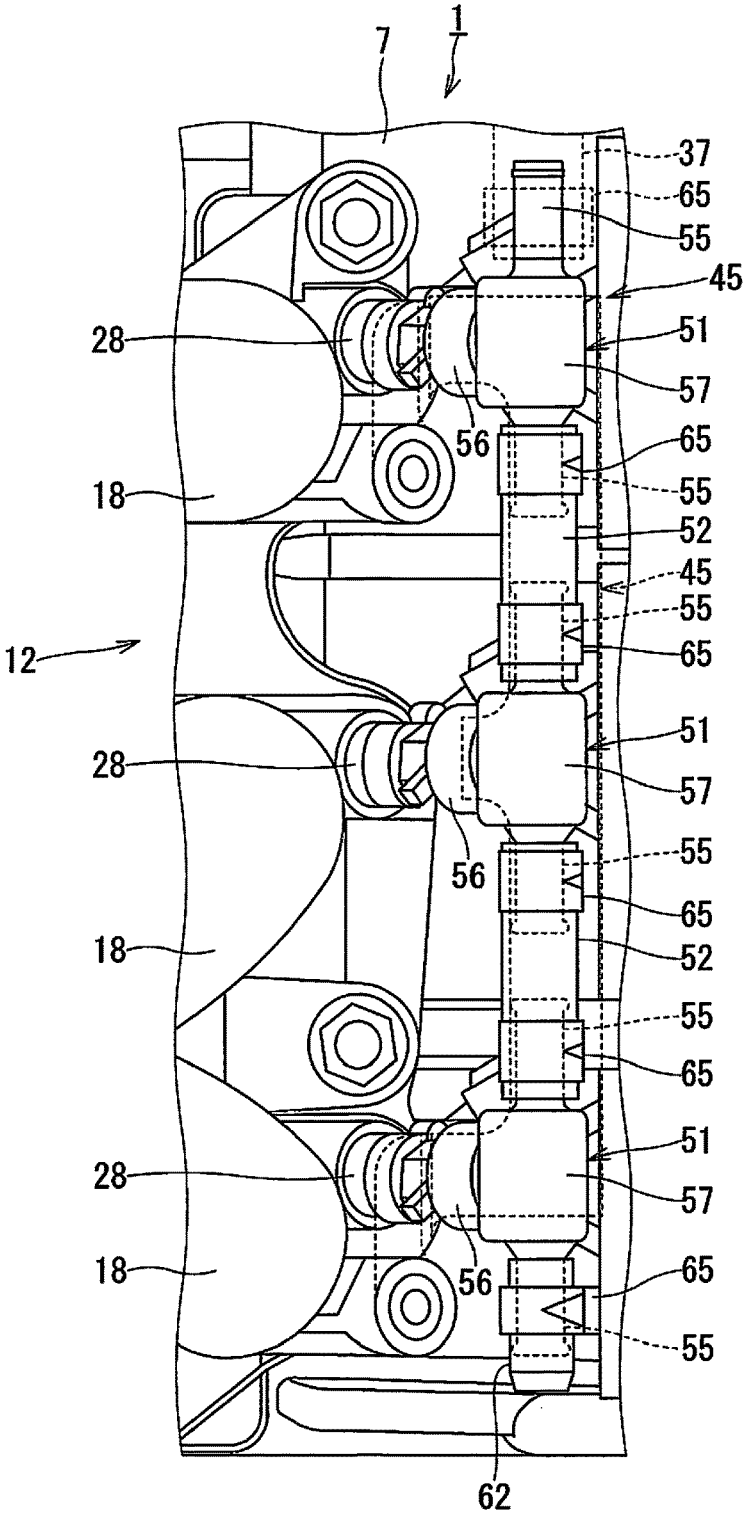
FIG. 4 is an enlarged view of the fuel supply piping of the fuel supply device according to the embodiment of the present invention.

FIG. 3 and FIG. 4 are enlarged views of the fuel supply piping of the fuel supply device according to the embodiment of the present invention.

Figure 5:
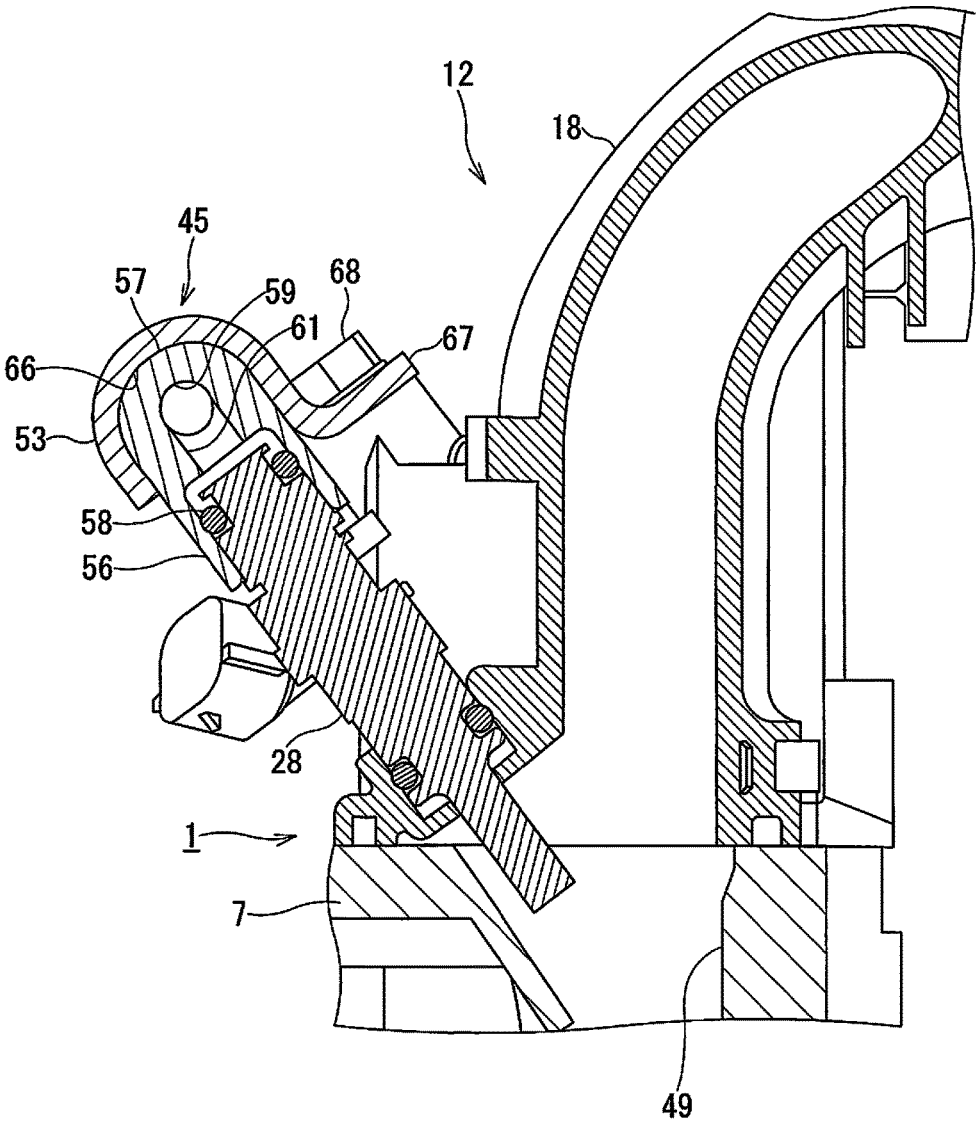
FIG. 5 is a sectional view of the fuel supply piping of the fuel supply device according to the embodiment of the present invention.

FIG. 5 is a sectional view of the fuel supply piping of the fuel supply device according to the embodiment of the present invention.

As illustrated in FIG. 3 to FIG. 5, the fuel supply piping 45 of the fuel supply device 12 according to the present embodiment distributes the fuel discharged from the high pressure fuel pump 26 to the fuel injectors 28.

The fuel injectors 28 are fixed to the intake manifolds 18 of the intake device 11. The fuel injectors 28 inject high-pressure fuel to intake ports 49 in the cylinder head 7, and generate mixture gas in which intake air and the fuel are mixed.

The fuel supply piping 45 includes a plurality of sockets 51 that are respectively connected to the fuel injectors 28, junction pipes 52 that connect adjacent sockets 51 among the sockets 51, a stay 53 that integrally connects the sockets 51 and fixes the sockets 51 to a main body of the engine 1.

The socket 51 is an integrally molded product in a substantially T-shape, and includes a pair of junction fittings 55, an outlet fitting 56 that is connected to the fuel injector 28, and a protruded portion 57 for fitting.

A pair of junction fittings 55 aligns and extends in opposite directions from each other. The junction fittings 55 have a cylindrical body having substantially equal measurements. The junction fitting 55 extends in such a manner as to protrude from the protruded portion 57.

The outlet fitting 56 is externally fitted onto an end portion of the fuel injector 28. A ring-shaped seal member 58 is provided in the outlet fitting 56. The seal member 58 prevents leakage of fuel in a space between the outlet fitting 56 and the fuel injector 28.

The protruded portion 57 is fitted to the stay 53, and is connected to the stay 53. The protruded portion 57 is sandwiched by the pair of junction fittings 55.

The socket 51 includes a junction flow passage 59 that crosses the pair of junction fittings 55, or penetrates through centers of the pair of junction fittings 55, and an outlet flow passage 61 that branches from the junction flow passage 59 and guides fuel to the fuel injector 28 in the outlet fitting 56.

The junction fitting 55 plays a role of an inlet of the fuel supply piping 45 not only by being inserted into the junction pipe 52 that connects the adjacent sockets 51 but also by being inserted into the high pressure fuel hose 37 that guides the fuel to the fuel supply piping 45. The junction fitting 55, which is located at an opposite side to an inlet end of the fuel supply piping 45, is closed by being inserted into a cap 62.

The junction pipe 52 has such an inner diameter dimension that the junction fitting 55 of the socket 51 can be fitted therein. The junction pipe 52 is a pressure-resistant hose formed from a rubber-like soft material. The junction pipe 52 is fixed to the junction fitting 55 by fastening a clamp band 65.

The stay 53 extends in a gutter shape with a U-shaped section that is fitted onto the protruded portion 57 of the socket 51. The stay 53 is fitted onto the protruded portions 57 of the respective sockets 51 to connect all of the sockets 51. That is, the stay 53 has a recessed portion 66 with a U-shaped section that is fitted onto the protruded portion 57 of the socket 51 throughout an entire length. In other words, the sockets 51 and the stay 53 are fitted to each other by the protruded portions 57 and the recessed portion 66. The stay 53 covers the junction pipe 52 from outside with a portion that stretches over or is laid over the adjacent sockets 51.

The stay 53 includes a mounting flange 67 that fixes the fuel supply piping 45 to the engine 1. The mounting flanges 67 are fixed to the intake manifolds 18 with fasteners 68 such as bolts. The mounting flanges 67 are respectively provided at both end portions of the stay 53 in a long shape.

Figure 6:
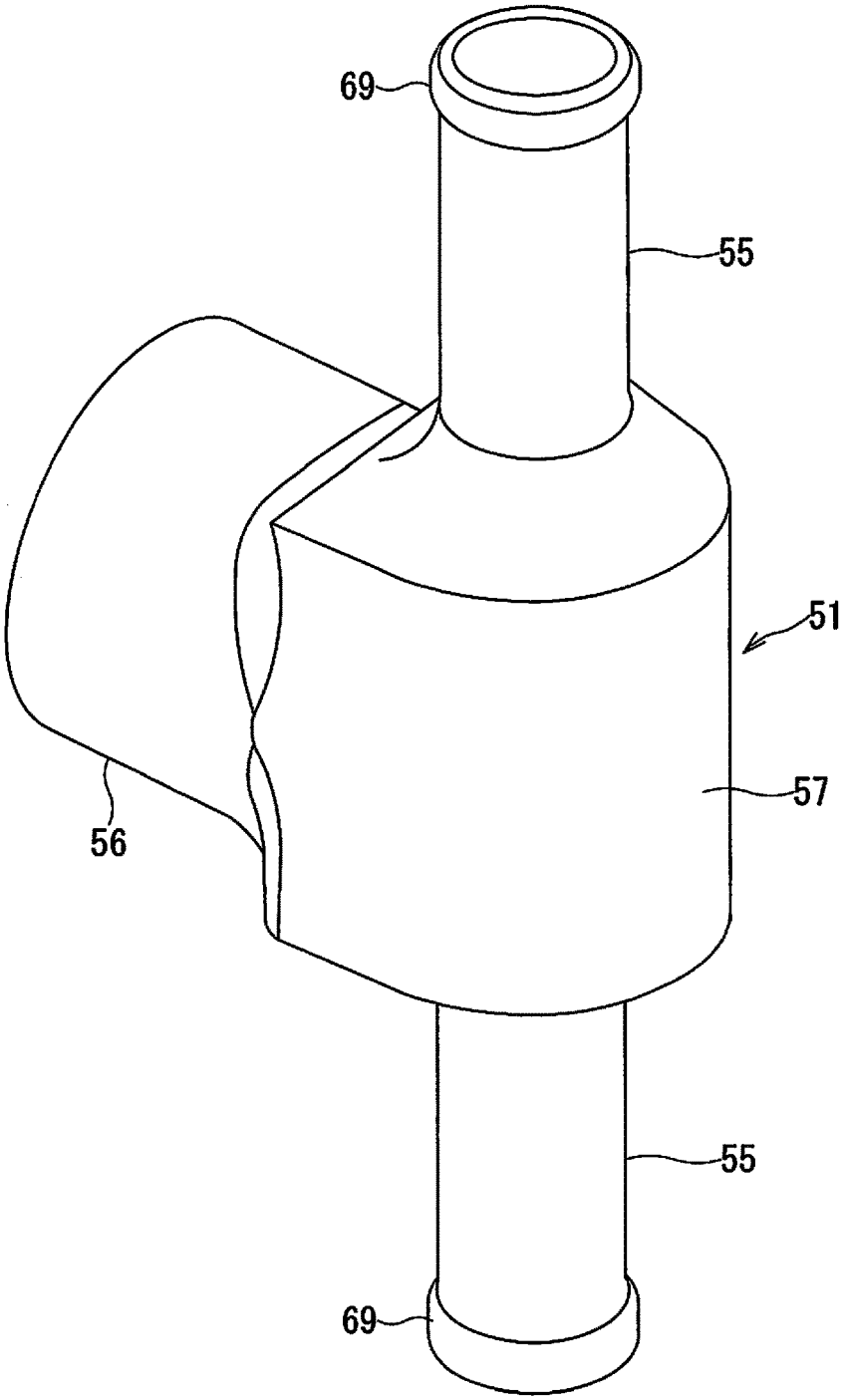
FIG. 6 is a perspective view of a socket of the fuel supply device according to the embodiment of the present invention.

FIG. 6 is a perspective view of the socket of the fuel supply device according to the embodiment of the present invention.

As illustrated in FIG. 6, the socket 51 of the fuel supply device 12 according to the present embodiment has flanges 69 that are provided at a distal end portion of the junction fittings 55. The flanges 69 are laid on an entire circumference of the distal end portion of the junction fittings 55. The flanges 69 cooperate with the clamp band 65 and prevent the junction pipes 52 removing from the junction fittings 55.

The fuel supply device 12 of the engine 1 according to the present embodiment connects the sockets 51 that divide the fuel supply piping 45 for each of the cylinders or each of the fuel injectors 28 with the junction pipes 52, and distributes fuel to the respective fuel injectors 28. Consequently, the fuel supply device 12 can use the sockets 51 in the same shapes commonly irrespective of the number of cylinders of the engine 1, and a distance between the adjacent fuel injectors 28. That is, the fuel supply device 12 can be adapted to the engines 1 of various and multiple kinds of specifications by mainly changing the number of sockets 51, the number and the length of the junction pipes 52, and the length of the stay 53, in accordance with the specifications of the engines 1. The fuel supply device 12 can contribute to reduction in cost by enhancing versatility without being redesigned for the specifications of each of the engines 1, or producing a molding die.

Further, in the fuel supply device 12 of the engine 1 according to the present embodiment, the plurality of sockets 51 are connected with the integral stay 53, and are fixed collectively. Consequently, the fuel supply device 12 can contribute to reduction in cost by limiting a space necessary for fixing to a minimum as compared with the case in which the socket 51 is simply divided and the respective sockets 51 are individually fixed, enhancing a degree of freedom of disposition of the fuel injector 28 and the fuel supply piping 45, and suppressing a working amount required to assemble the fuel supply piping 45.

Furthermore, the fuel supply device 12 of the engine 1 according to the present embodiment includes the gutter-shaped stay 53, and thus the recessed portion 66 in which the protruded portion 57 of the socket 51 is fitted extends along the entire length of the stay 53. This significantly relieves positional precision and dimensional precision of the protruded portion 57 and the recessed portion 66 in a longitudinal direction of the stay 53, and contributes to simplification of the shape of the fuel supply piping 45 to eventually reduce cost. Further, in the fuel supply device 12, a degree of freedom of a combination of the stay 53 and the sockets 51 is high, and the fuel supply device 12 can be flexibly adapted to disposition of the fuel injectors 28.

Furthermore, in the fuel supply device 12 of the engine 1 according to the present embodiment, the junction pipes 52 are covered with the stay 53, and thereby an outer appearance is improved. Further, in the fuel supply device 12 of the engine 1 according to the present embodiment, the junction pipes 52 are covered with the stay 53, whereby even when the junction pipes 52 which are soft and low in strength are used, the junction pipes 52 can be protected without using a separate component such as a protector.

Therefore, the fuel supply device 12 of the engine 1 according to the present invention has high versatility irrespective of the specifications of the engine 1, and thus easily achieves economies of mass production, and can enhance cost-effectiveness even in the engine 1 of small-lot production.

What is claimed is:

1. A fuel supply device of an engine, the fuel supply device comprising:

a fuel pump raising pressure of fuel and discharging the fuel;

a plurality of fuel injectors;

a fuel supply piping distributing the fuel discharged from the fuel pump to the fuel injectors, wherein the fuel supply piping includes a plurality of sockets connected to the fuel injectors respectively, at least one junction pipe connecting adjacent sockets such that each socket divides fuel supply piping for a corresponding cylinder of a plurality of cylinders of the engine; and a stay integrally connecting the sockets and collectively fixing the sockets to an engine main body.

2. The fuel supply device of claim 1, wherein each socket of the plurality of sockets has a protruded portion on which the stay is fitted, and the stay has a recessed portion with a U-shaped section fitted onto the protruded portion, and extending in a gutter shape.

3. The fuel supply device of claim 1, wherein the stay covers the junction pipe from outside.

4. The fuel supply device of claim 2, wherein the stay covers the junction pipe from outside.

5. The fuel supply device of claim 1, wherein each socket of the plurality of sockets includes an outlet fitting that is connected to a corresponding fuel injector and a protruded portion for fitting.

6. The fuel supply device of claim 1, wherein each socket of the plurality of sockets includes a pair of junction fittings.

7. The fuel supply device of claim 6, wherein the pair of junction fittings align and extend in opposite directions from each other.

8. The fuel supply device of claim 6, wherein the junction fittings have a cylindrical body having substantially equal measurements.

9. The fuel supply device of claim 8, wherein each socket of the plurality of sockets further includes an outlet fitting that is connected to a corresponding fuel injector and a protruded portion for fitting.

10. The fuel supply device of claim 9, wherein each junction fitting extends in each socket so as to protrude from the protruded portion.

11. The fuel supply device of claim 8, wherein each outlet fitting is externally fitted onto an end portion of a corresponding fuel injector.

12. The fuel supply device of claim 8, wherein each outlet fitting of each socket of the plurality of sockets includes a ring-shaped seal member provided in the outlet fitting that prevents leakage of fuel in a space between the outlet fitting and the fuel injector 28.

13. The fuel supply device of claim 8, wherein each protruded portion of each socket of the plurality of sockets is fitted to and connected to the stay.

14. The fuel supply device of claim 8, wherein each protruded portion of each socket of the plurality of sockets is sandwiched between the pair of junction fittings for the socket.

15. The fuel supply device of claim 1, wherein each socket of the plurality of sockets includes a junction flow passage that crosses a pair of junction fittings included in the socket, or penetrates through centers of the pair of junction fittings, and an outlet flow passage that branches from the junction flow passage and guides fuel to the corresponding fuel injector in an outlet fitting.

* * * * *